United States Patent [19]

Hürlimann

[11] 3,994,228

[45] Nov. 30, 1976

[54] PROJECTILE FUZE FOR A SPINNING PROJECTILE CONTAINING A DETONATOR CAP AND AN ELECTROMAGNETIC FIRING OR IGNITION CURRENT GENERATOR

[75] Inventor: Walter Hürlimann, Watt, Regensdorf, Switzerland

[73] Assignee: Werkzeugmaschinenfabrik Oerlikon-Buhrle AG, Zurich, Switzerland

[22] Filed: Apr. 28, 1975

[21] Appl. No.: 571,977

[30] Foreign Application Priority Data

May 10, 1974 Switzerland ..... 6397/74

[52] U.S. Cl. ..... 102/70.2 G; 102/70.2 GA

[51] Int. Cl.[2] ..... F42C 11/02; F42C 11/04

[58] Field of Search ..... 102/70.2 G, 70.2 GA, 102/79

[56] References Cited

UNITED STATES PATENTS

| | | | |
|---|---|---|---|
| 2,825,283 | 3/1958 | Sobelman | 102/70.2 G |
| 2,972,306 | 2/1961 | Kabik et al. | 102/70.2 GA |
| 3,505,960 | 4/1970 | Theate | 102/79 |
| 3,747,529 | 7/1973 | Plather | 102/70.2 GA |

FOREIGN PATENTS OR APPLICATIONS

| | | | |
|---|---|---|---|
| 304,254 | 10/1920 | Germany | 102/70.2 G |

*Primary Examiner*—Verlin R. Pendegrass
*Attorney, Agent, or Firm*—Werner W. Kleeman

[57] ABSTRACT

A projectile fuze for a spinning projectile containing a detonator cap and an electromagnetic ignition current generator which possesses as a first component of the generator a permanent magnet and as a second component of the generator an armature coil, wherein one generator component is fixedly mounted and the other generator component is rotatably mounted, the armature coil being connected through the agency of electrical elements with the detonator cap. The rotatable generator component is formed by the armature coil which together with the electrical elements and the detonator cap is arranged in a rotatably mounted cage.

4 Claims, 6 Drawing Figures

FIG. 2
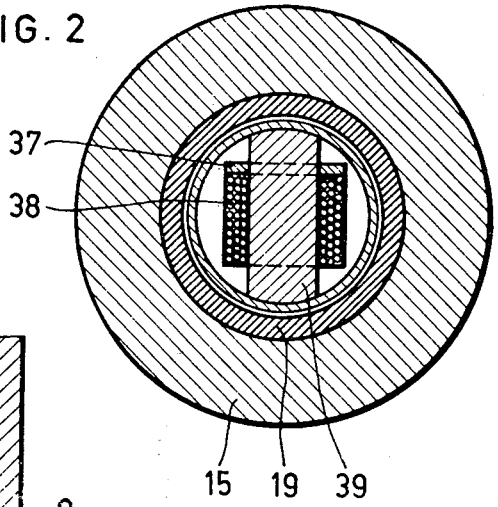
FIG. 1
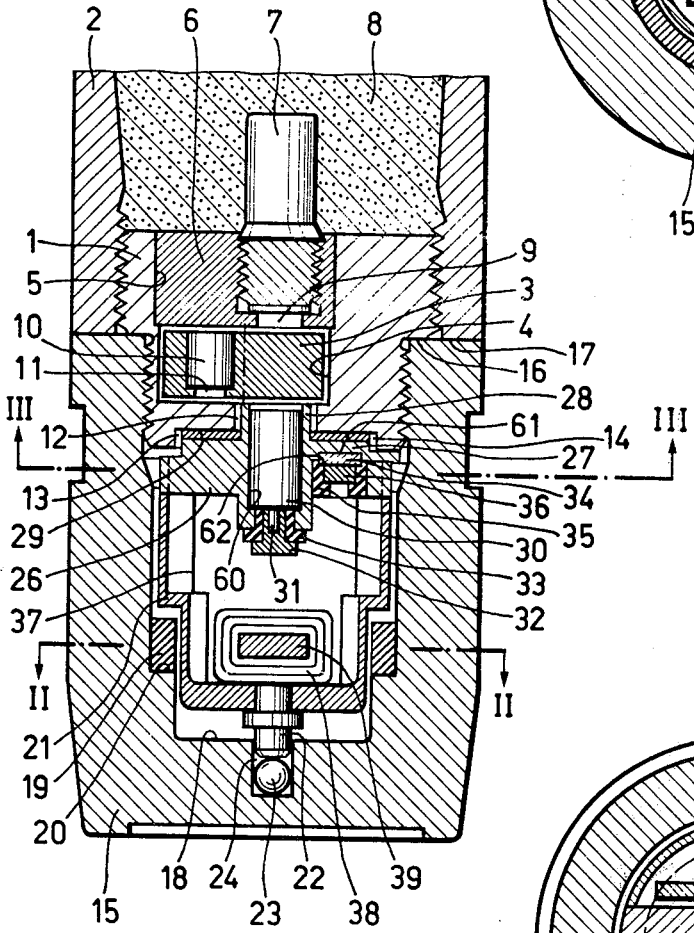
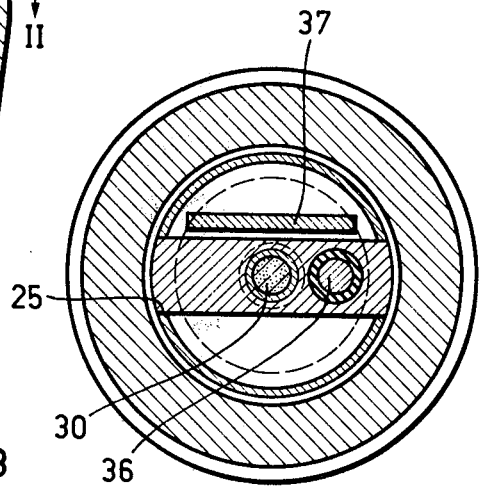
FIG. 3

PROJECTILE FUZE FOR A SPINNING PROJECTILE CONTAINING A DETONATOR CAP AND AN ELECTROMAGNETIC FIRING OR IGNITION CURRENT GENERATOR

BACKGROUND OF THE INVENTION

The present invention relates to a new and improved construction of projectile fuze for a spinning or rifled projectile containing a detonator cap and an electromagnetic ignition current generator which comprises a permanent magnet as a first component of the generator and an armature coil as the second component of the generator, wherein one generator component is fixedly mounted and the other generator component is rotatably mounted in the fuze housing, the armature coil being cconnected via electrical elements with the detonator cap.

According to a state-of-the-art projectile fuze of this type the permanent magnet is rotatably mounted as a generator component in the fuse housing. The armature coil or winding consitituting the second generator component, the detonator cap and the electrical elements are fixedly assembled in the housing.

This prior art arrangement is associated with the drawback that for constructional reasons it is not possible to design the permanent magnet so large that its moment of inertia is sufficient to maintain its rotational speed small relative to the rotational speed of the projectile in order that because of a large differrence between the rotational speed of the armature coil and field magnets there is produced electrical energy which is adequate for the ignition of an explosive charge.

SUMMARY OF THE INVENTION

It is a primary object of the present invention to provide an improved construction of projectile fuze for a spinning projectile containing a detonator cap and an electormagnetic ignition current generator which is not associated with the aforementioned drawbacks and limitations of the prior art proposals.

Another and more specific object of the invention aims at avoiding the aforementioned drawbacks and to increase the moment of inertia of the rotatably mounted generator component, without increasing the total weight of the projectile fuze, in order to be able to increase the relative rotational speed between both generator components so as to generate electrical energy which is adequate for ignition purposes.

Now in order to implement these and still further objects of the invention, which will become more readily apparent as the description proceeds, the invention is manifested by the features that the rotatable generator component is constituted by the armature coil or winding which together with the electrical elements and the detonator cap is arranged in a rotatably mounted cage.

By virtue of the fact that, apart from the armature coil, also the lectrical elements, such as the capacitor, switching plate, rectifier means and additionally the detonator cap are arranged in a rotatably mounted cage, the weight and therefore also the moment of inertia of the rotating generator component is appreciably increased.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a fragmentary longitudinal sectional view through a projectile fuze equipped with electromagnetic ignition or firing current generator and constructed according to a first exemplary embodiment of the invention;

FIG. 2 is a cross-sectional view of the arrangement of FIG. 1, taken substantially along the line II–II thereof;

FIG. 3 is a cross-sectional view of the arrangement of FIG. 1, taken substantially along the line III–III thereof;

DETAILED DESCRIPTION OF THE INVENTION

Figure 5:
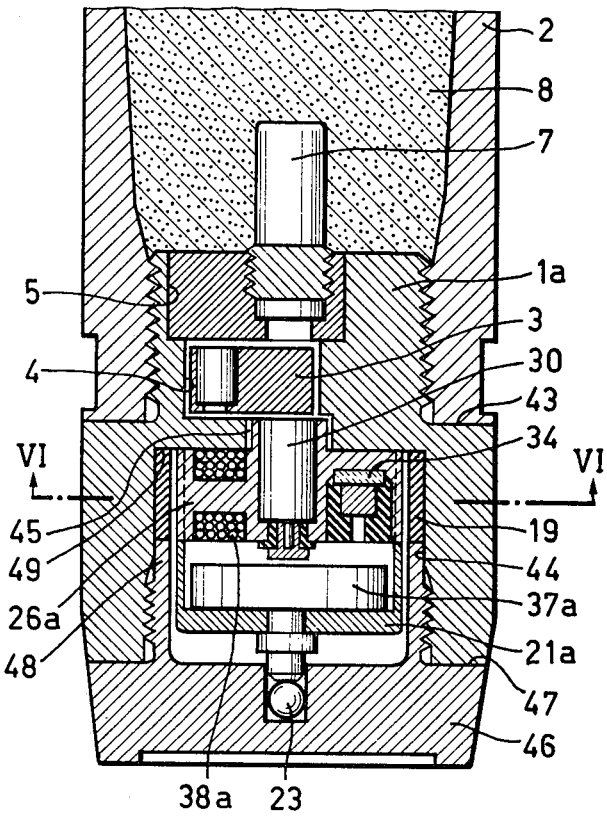
FIG. 5 is a fragmentary longitudinal sectional view, corresponding to the showing of FIG. 1, of a further exemplary embodiment of the invention.

Describing now the drawings, it is to be understood that only enough of the projectile structure has been shown in order to enable those skilled in the art to readily understand the basic concepts of the invention. Turning attention to FIG. 1 there is illustrated a fuze housing 1 which is threaded into the rear portion of a projectile body 2. Machined into the fuze housing 1 from the front end face thereof is a bore 4, 5 which is stepped in diameter and eccentrically arranged with respect to the lengthwise axis of the projectile, as best seen by referring to FIG. 1. A rotor 3 is rotatably mounted at the narrower bore portion 4. Pressed into the front bore portion 5 is a disk 6. A reinforcement charge 7 is threaded from the end face of the fuze housing 1 into the disk or plate 6 so as to be coaxially disposed with respect to the lengthwise axis of the projectile. The reinforcement charge 7 protrudes into an explosive charge 8 which is contained in the projectile body 2. Furthermore, reinforcement charge 7 is in spatial communication with the bore portion 4 by means of a bore 9. A detonator 10 is inserted into a continuous bore 11 of rotor 3, and the spacing of the bore 11 from the central axis of the rotor is equal to the spacing of the rotor axis from the projectile axis. The fuze housing 1 furthermore exhibits a bore 12, 13 which is stepped in diameter and which is machined from the rear end face of such fuze housing. The front bore portion 12 opens into the bore 4. Both of the bore portions 12, 13 are separated from one another by a shoulder 14.

A tail or rear body portion 15 is threadably connected with the fuze housing 1. The end face or surface of the tail body 15 bears against a shoulder 16 of the fuze housing 1 and also bears at the rear end face or surface 17 of the projectile body 2. The tail or rear body 15 possesses a blindhole bore 18 which is stepped in diameter. A substantially ring-shaped permanent magnet 19 possessing two salient poles which are situated diametrically opposite one another bears against a bore shoulder 20 of the tail body 15 and is secured in the bore 18. The front open portion of a substantially cup-shaped cage 21 has a larger diameter than its rear portion. In the floor or base of the cage 21 there is secured a pin or plug 22. The pin 22 bears against a ball or spherical member 23 which is arranged in a blindhole bore 24 machined from the base of the bore 18 into the tail body 15. The cage 21 is provided at its front edge with two diametrically oppositely situated openings of cut-outs 25 (FIG. 3) in which there is attached a carrier or support 26. The support 26 possesses at its front end face a circular projection 27 which terminates in a plug or journal 28. This plug or journal 28 protrudes into the bore 12 of the fuze housing 1 and serves to mount the cage 21 therein. Between the support 26 and the fuze housing 1 there is inserted a ring member or ring 29 formed of "TEFLON". The mounting of the cage 21 is undertaken such that its support 26 in the rest condition is slightly pressed against the "TEFLON" ring 29, so that it is secured against rotation.

The axis of a central, continuous bore 60 of the support 26, and which bore is stepped in diameter, substantially coincides with the lengthwise axis of the projectile. A detonator cap 30 having a flame-generating firing means is inserted in this bore 60. The one pole of the electrical ignition or firing current circuit for the firing means is connected with the mass of the support 26 and the other pole 31 extends into a plug element 32 which is mounted in an insulation element 33 arranged in the stepped bore 60.

A piezoelectric cystal 34 is located at the base of a bore 61 of the support 26 which is open behind the rear end surface or face of such support. An insulating body member 35 is arranged in this bore 61. An inertia body 36 is movably mounted in a bore 62 of the insulation body or insulator 35 and bears against the piezoelectric cystal 34. An essentially rectangular switching or wiring plate 37 is arranged in the cage 21 in such a manner that its lengthwise central axis is parallel to the projectile axis and possesses a certain spacing therefrom.

Figure 4:
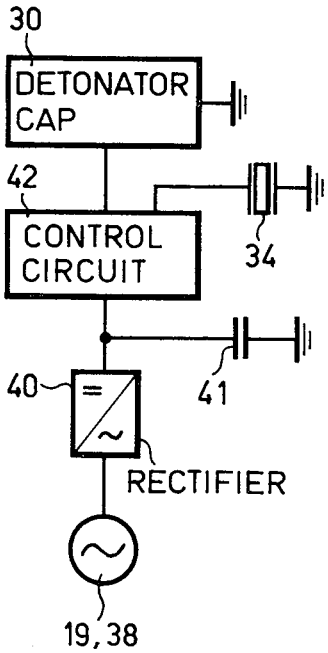
FIG. 4 is a block circuit diagram of the fuze construction.

A coil or winding 38 is would about an armature core 39 which is oriented substantially perpendicular to the lengthwise axis of the projectile, penetrates through the switching plate 37 and is connected with the cage 21. The components 38 and 39 will be hereinafter conveniently referred to as the armature arrangement. The radial central plane of permanent magnet 19 essentially coincides with the equally directed central plane of the armature arrangement 38, 39. ACcording to the showing of FIG. 4 there is provided for the purpose of rectification of the alternating-current generated by the electromagnetic generator 19, 38, 39 a rectifier or rectifier arrangement 40, and for the storage of such current an electrical capacitor 41. This capacitor 41 is electrically connected with the detonator cap 30 through the agency of a control circuit 42 which controls different operating conditions of the fuze. The piezoelectric crystal 34 is connected to the control circuit 42. The rectifier 40 and the capacitor 41 are arranged in a not particularly illustrated manner in the cage 21 between the armature arrangement 38, 39 and the support 26.

Now since both the armature arrangement 38, 39 as well as the detonator cap 39 with the flame ignition means are arranged in the cage 21, it is possible to wire the fuze independently of a projectile which houses the fuze. This furthermore affords the advantage that the entire fuze including the current circuit across the detonator cap 30 can be checked externally of the projectile and removed from its explosive charge 8.

Having now had the benefit of the foregoing description of the embodiment of projectile fuze for a spinning projectile as considered above with respect to FIGS. 1 to 4 there will now be discussed the mode of operation:

Prior to firing of the projectile the fuze chain or circuit consisting of the detonator cap 30, the detonator 10 and the reinforcement charge 7 is interrupted in that the detonator 10 is located externally of the projectile axis. Upon firing of the projectile carrying the fuze the ball 23, owing to the load of the inertia force applied at the cage 21, slightly penetrates into the tail or rear body 15. Consequently, there is now imparted to the cage 21 its freedom of movement, so that it can carry out a rotation with respect to the projectile. During the passage of the projectile through the firing barrel of the weapon from which it is fired the projectile is accelerated to a very high rotational speed. Since at the plug 22 of the cage 21 a frictional force engages at only a very small lever arm this cage experiences a correspondingly small rotational drive. The rotational speed of the cage 21 is therefore only very small owing to the large moment of inertia of its mass, so that the difference between the rotational speed of the permanent magnet 19 and the cage 21 which is important for generating the current is practically equal to the rotational speed of the projectile. When the projectile after leaving the firing barrel is decelerated due to the resistance of the air, then the cage 21 under the action of the inertia force which is applied thereat bears via the "TEFLON" ring 29 at the fuze housing 1. Consequently, the cage 21 experiences a rotational acceleration which, however, owing to the fact that the capacitor 41 has already been charged, is no longer of importance.

After the projectile has departed from the firing barrel then the rotor 3 is rotated for the purpose of closing the fuze circuit or chain 30, 10, 7. The inertia body 36, upon impact of the projectile at the target, is braked by the piezoelectric crystal 34. The current which is generated due to loading of the piezoelectric crystal 34 by means of the inertia body 36 is used for controlling the ignition of the flame ignition means in the detonator cap 30. By means of the detonator cap 30 there is initiated through the agency of the detonator 10 and the reinforcement charge 7 the detonation of the projectile explosive charge 8.

Figure 6:
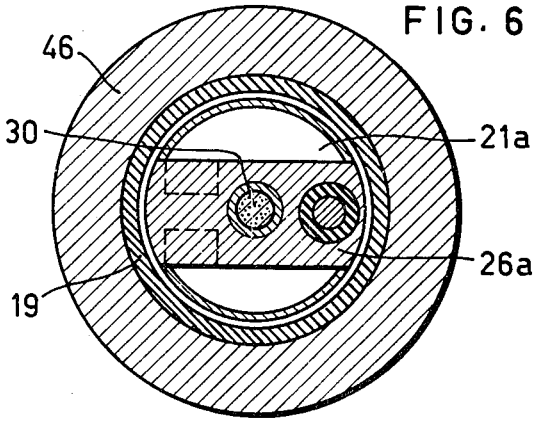
FIG. 6 is a cross-sectional view of the arrangement of FIG. 5, taken substantially along the line VI–VI thereof.

Continuing, there will now be considered the variant embodiment of the invention as the same has been shown in FIGS. 5 and 6. It is to be appreciated that for this variant embodiment the same components have been designated by the same reference characters, whereas components which differ in their configuration have been designated in FIGS. 5 and 6 with the same reference character but in addition thereto by the lower case letter *a*, and finally, components not present in the construction of FIGS. 1 to 3 have been designated with a new reference character.

With the exemplary embodiment depicted in FIGS. 5 and 6 the fuze housing 1*a*, which contains the reinforcement charge cap 7 and the rotor 3, forms an extension of the projectile body 2. The fuze housing 1*a* which bears by means of a shoulder 43 at the projectile body 2 possesses a bore 44, 45 which is stepped in diameter towards the front and which opens into the bore 4. The base piece 46 of the projectile bears by means of a flange edge 47 at the fuze housing 1*a*. A sleeve-shaped projection 48 of the base or bottom piece 46 extends into the bore 44 of the fuze housing 1*a* and is threadably connected therewith. A substantially ring-shaped permanent magnet 19 is arranged between the end surface or face of the projection 48 and the bore shoulder 49. The cage 21*a* bears through the agency of a ball 23 at the base piece 46. A further difference which is present in this embodiment from the first exemplary embodiment previously discussed resides in the fact that the support 26*a* forms the armature core at which there is wound offset from the center the coil 38*a* which is situated diametrically opposite the piezoelectric crystal 34. The switching or wiring plate 37*a* is arranged between the support 26*a* and the floor or base of the cage 21*a*. The advantage of the second exemplary embodiment of this development resides in the fact that owing to the use of the support 26*a* as the armature core it is possible to reduce the length of the cage 21*a* with respect to that of the first exemplary embodiment. In this way the projectile can be provided with a greater quantity of explosive charge.

While there is shown and described present preferred embodiments of the invention, it is to be distinctly understood that the invention is not limited thereto, but may be otherwise variously embodied and practiced within the scope of the following claims.

Accordingly, what is claimed is:

1. A projectile fuze for a spinning projectile, comprising a. a fuze housing;
b. a detonator cap;
c. an electromagnetic ignition generator containing
  i. a permanent magnet
  ii. an armature coil
d. said permanent magnet being fixedly supported at the fuze housing and said armature coil being rotatable with respect to the fuze housing;
e. electrical elements for connecting the armature coil with the detonator cap;
f. a rotatably mounted cage containing;
  i. said electrical elements,
  ii. said detonator cap, and
  iii. said armature coil.

2. A projectle fuze for a spinning projectile, comprising a. a fuze housing;
b. a detonator cap;

3. an electromagnetic ignition current generator containing:

i. a permanent magnet;
  ii. an armature coil;

d. said permanent magnet being fixedly supported at the fuze housing and said armature coil being rotatable with respect to the fuze housing;
e. electrical elements for connecting the armature coil with the detonator cap containing
  i. a piezoelectric crystal
  ii. an inertia body located behind the piezoelectric crystal with respect to the direction of flight of the projectile, said inertia body upon impact of the projectile exerting by virtue of its inertia a pressure upon the piezoelectric crystal for generating a control current for connecting the armature coil with the detonator cap;
f. a rotatably mounted cage containing
  i. said electrical elements with said crystal,
  ii. said detonator cap, and
  iii. said armature coil.

3. The projectile fuze as defined in claim 2, wherein a. said armature coil has an armature core;
b. said cage is provided with a support
  i. said support forming the armature core of the armature coil,
  ii. said support having a bore for receiving the detonator cap.

4. The projectile fuze as defined in claim 3, wherein a. said armature coil has an armature core;
b. said cage is provided with two supports
  i. a first support for receiving the detonator cap, and
  ii. a second support forming the armature core of the armature coil.

* * * * *